US007152584B2

(12) United States Patent
Odoni et al.

(10) Patent No.: US 7,152,584 B2
(45) Date of Patent: Dec. 26, 2006

(54) COMBUSTION-ENGINED SETTING TOOL

(75) Inventors: Walter Odoni, Planken (LI); Mario Grazioli, Chur (CH); Ulrich Rosenbaum, Wangs (CH); Hans Gschwend, Buchs (CH); Ulrich Schiestl, Feldkirch (AT)

(73) Assignee: Hilti Aktiengesellscahft, Schaan (LI)

( * ) Notice: Subject to any disclaimer, the term of this patent is extended or adjusted under 35 U.S.C. 154(b) by 401 days.

(21) Appl. No.: 10/670,067

(22) Filed: Sep. 23, 2003

(65) Prior Publication Data

US 2004/0112309 A1 Jun. 17, 2004

(30) Foreign Application Priority Data

Sep. 24, 2002 (DE) ..... 102 44 250

(51) Int. Cl.
*F02M 51/06* (2006.01)

(52) U.S. Cl. ..... 123/460; 227/10

(58) Field of Classification Search ..... 123/46 H, 123/299, 460; 227/10
See application file for complete search history.

(56) References Cited

U.S. PATENT DOCUMENTS 6,019,072 A * 2/2000 Phillips et al. ..... 123/46 H
6,722,548 B1 * 4/2004 Odoni et al. ..... 227/8
6,877,308 B1 * 4/2005 Voelker et al. ..... 60/39.6

* cited by examiner

*Primary Examiner*—Stephen K. Cronin
*Assistant Examiner*—Katrina B. Harris
(74) *Attorney, Agent, or Firm*—Abelman, Frayne & Schwab

(57) ABSTRACT

The present invention relates to a combustion-engined setting tool for driving fastening elements such as nails, bolts, pins and the like in a constructional component and including a fuel source (11), a fuel conduit (12), from the fuel source (11) to the combustion chamber (13), at least one metering device (30) arranged in the fuel conduit (12) between the fuel source (11) and the combustion chamber (13). The setting tool further includes a control device (20) for operating the metering device. The metering device (30) is formed for metering out fuel in form of a n-number of discrete separate portions, with a volume of separate portions being preset and remaining constant.

16 Claims, 5 Drawing Sheets

COMBUSTION-ENGINED SETTING TOOL

BACKGROUND OF THE INVENTION

1. Field of the Invention

The present invention relates to a combustion-engined setting tool for driving fastening elements, such as nails, bolts, pins, etc . . . in a constructional component and including a combustion chamber, a fuel source, a fuel conduit for connecting the fuel source with the combustion chamber, at least one metering device arranged in the fuel conduit; and a control device for actuation of the metering device.

2. Description of the Prior Art

The setting tools of the type described above are operated on gaseous or liquid fuels which are combusted in a combustion chamber and drive a drive piston for driving in fastening elements.

Generally, the problem with fuel consists in admixing, in each operational cycle, of a proper amount of air or oxygen, which constitutes oxidation means, to the fuel. The amount of oxygen, which is available for combustion, depends to a great extent on the surrounding temperature, air pressure, and air humidity. The necessary amount of fuel, which takes part in combustion, changes within a wide range, dependent on the above-mentioned parameters, up to 40% in an extreme case. The variations of the amount of fuel adversely affect the combustion of the air-fuel mixture when the air-fuel mixture contains too much fuel or too little fuel.

German Publication DE-42 43 617A1 discloses a setting tool in which in each working cycle, a gas inlet valve opens mechanically, with an amount of fuel fed from a fuel source into a storage space through the valve being dependent on the surrounding conditions. In this way, the pressure and, if necessary, the temperature is (are) equalized with that (those) of the surrounding air, whereby a proper air-fuel mixture is fed into the combustion chamber. The fuel is fed from the storage space at a predetermined time.

The drawback of the tool of DE 42 43 617 A1 consists in that the dependence on the parameters of the surrounding air can lead to loss of fuel. Further, the pressure in the metering chamber is not controlled.

European Publication EP-0 597 241 B1 discloses a combustion-engined setting tool in which fuel is fed from a fuel source to the combustion chamber through a normally-closed, solenoid-controlled valve. The actuation of the solenoid is effected electronically by a switching circuit in response to actuation of a switch, with the valve being open at a controlled, predetermined time interval for feeding fuel from a fuel source to the combustion chamber.

The drawback of this tool consists in that at variations of the admission pressure in the fuel source, the flow velocity of fuel varies, and a precise amount of fuel cannot be metered-out.

Accordingly, an object of the invention is to provide a setting tool of a type discussed above in which the drawbacks of the prior art tools are eliminated.

SUMMARY OF THE INVENTION

This and other objects of the present invention, which will become apparent hereinafter, are achieved by providing a setting tool the metering device of which is so formed that it meters out a predetermined amount of fuel in form of a n-number of discrete separate portions, with a preset volume of each separate portion remaining constant.

According to the present invention, the metering device meters out the required fuel volume in form of a plurality of small, equal volume, separate portions. The metering takes place in accordance with the calculated number of separate portions. By changing the number of separate portions, the total metered amount of fuel can be changed. In this way, the feeding of the fuel from the fuel source to the combustion chamber is effected rhythmically or in form of pulses. The present invention insures a very precise metering of both liquid and gaseous fuels.

According to an advantageous embodiment of the present invention, there is provided, in the setting tool, sensor means, e.g., sensors for determining, e.g., the tool temperature, the surrounding temperature, the humidity of the surrounding air, and/or the type of the constructional component. The acquired data are communicated to the control device, and the control device determines, for each following operational cycle, the number of separate portions to be fed form the fuel source into the combustion chamber. Upon the determination of the number of separate portions of fuel to-be-fed to the combustion chamber, the control device correspondingly controls the operation of the metering device, insuring that a correct number of separate portions is metered out.

Preferably, the metering device is associated with a counter that calculates the number of already measured and metered out separate portions. Advantageously, the counter transmits the acquired data to the control device that, if necessary, adjusts the number of separate portions still to be dispensed or metered out by the metering device.

According to the present invention, the metering device includes at least one metering chamber. The metering chamber has at least one inlet for admitting fuel into the metering chamber and at least one outlet for feeding fuel to the combustion chamber. Preferably, the inlet and outlet are closed by closing means such as, e.g., a check valve, a flap valve, or the like. The metering device can have more than one metering chamber. In this case, a separate portion is formed of the volumes or at least partial volumes of separate metering chambers.

Advantageously, when there is provided a plurality of metering chambers, they are arranged annularly about a common central axis. The advantage of annular arrangement of metering chambers consists in that all of the metering chambers can be closed by one and the same closing member arranged in front of the inlets of all of the chambers, and by one and the same closing member arranged in front of the outlets of all of the chambers. The closing members are preferably formed as rotationally-symmetrical members, with the metering chambers being arranged along a circle. For opening and closing of the metering chambers, the closing members, which are preferably formed as disc-shaped members having each at least one opening movable by or, more precisely, rotatable by respective inlets or outlets of the metering chambers. When the opening of the disc-shaped closing members pass by the inlets or the outlets of respective metering chambers, the respective metering chambers open at respective inlets or outlets, so that fuel can be admitted into the respective chambers or be expelled from the respective chambers.

According to the invention, the disc-shaped members, which can be driven, e.g., by a stepped motor, can be provided each with circular, segment-shaped slots, with the slots of the two disc-shaped members being offset relative to each other by 180°. The disc-shaped member are arranged, in the axial direction in front of and behind the metering chambers. With this arrangement of slots, half of the chambers will have their inlet opened, and half of the chambers will have their outlet opened. Thereby, all of the chambers are either connected with the fuel source or are connected with the combustion chamber. As soon as the inlets of the respective chambers open, the respective metering chambers are filled with a predetermined amount of fuel. When the outlets of the respective metering chambers open, the predetermined amount of fuel is fed to the combustion chamber. The metered-out amount of fuel is controlled by controlling the number of revolutions of the stepped motor. Thus, the metered-out amount of fuel, that is the number of separate portions, can be easily controlled by controlling the operation of the stepped motor with the control device. In order to insure that there is provided sufficient time for the fuel to flow in the metering chambers and to flow out therefrom, a provision of a certain minimal number of metering chambers can be advantageous.

When, e.g., eight metering chambers are provided in the metering device, the time for filling/evacuation of the metering chambers, at the same metering frequency, in four time exceeds the time for filling/evacuation of the metering chambers of a metering device provided only with two metering chambers. Instead of a rotational movement of the disc-shaped closing members which are arranged, respectively, in front of and behind the metering chambers arranged along a circle, there can be used a linear reciprocating movement or a pivotal movement in a predetermined angular range when the metering chambers are arranged along a straight line. With a linear arrangement of the metering chambers, the reciprocating linear movement or the pivotal movement can be effected using a solenoid.

Instead of the displacement of the disc-shaped members, the metering chambers can be made displaceable relative to the stationary closing disc-shaped members. This would permit to reduce the number of displaceable parts.

A metering device according to the present invention can have only one stationary metering chamber with a check valve provided in both the inlet and the outlet, which would insure flow of fuel only in the direction toward the combustion chamber. In this case, there is provided an oscillating displacement body (e.g., a piston, a diaphragm, etc . . . ) which insures that a predetermined amount of fuel, which is determined by a displacement volume of the displacement body, is either fed into the metering chamber or is expelled therefrom.

In the conduit section leading from the fuel source to the metering chamber, at least one check valve is so arranged that the fuel can flow only in the direction toward the metering chamber. In the conduit section leading from the metering chamber toward the combustion chamber, the check valve is so arranged that the fuel can flow only from the metering chamber in the direction toward the combustion chamber, but not in the opposite direction back into the metering chamber. When the displaceable body is located in the metering chamber, the volume of the chamber changes by a precisely predetermined amount. The displaceable body can be driven or displaced, e.g., by a drive motor controlled by the control device. With the displacement of the displaceable body, a corresponding amount of fuel is pressed out of the metering chamber (upon increase of the displacement volume of the displaceable body) or the corresponding amount is aspirated into the metering chamber (upon reduction of the displaceable volume of the displaceable body). The number of strokes or pulses of the displaceable body determines the number of the separate portions of fuel which are metered out by the metering device.

According to an advantageous embodiment of the present invention, the control device is formed as a data processing unit for evaluation and processing the acquired parameters. The advantage of forming the control device as a data processing unit consists in that, e.g., a known data pattern can be stored in the data processing unit, and the predetermined metering amounts, i.e., the number of separate portions, can be coordinated with the data pattern. The data processing unit also permits to accelerate the data processing speed and the output of the commands to the metering device. The data processing unit can be formed, e.g., as a microprocessor that can function alone or in combination with other electronic components.

The novel features of the present invention, which are considered as characteristic for the invention, are set forth in the appended claims. The invention itself, however both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENTS

Figure 1:
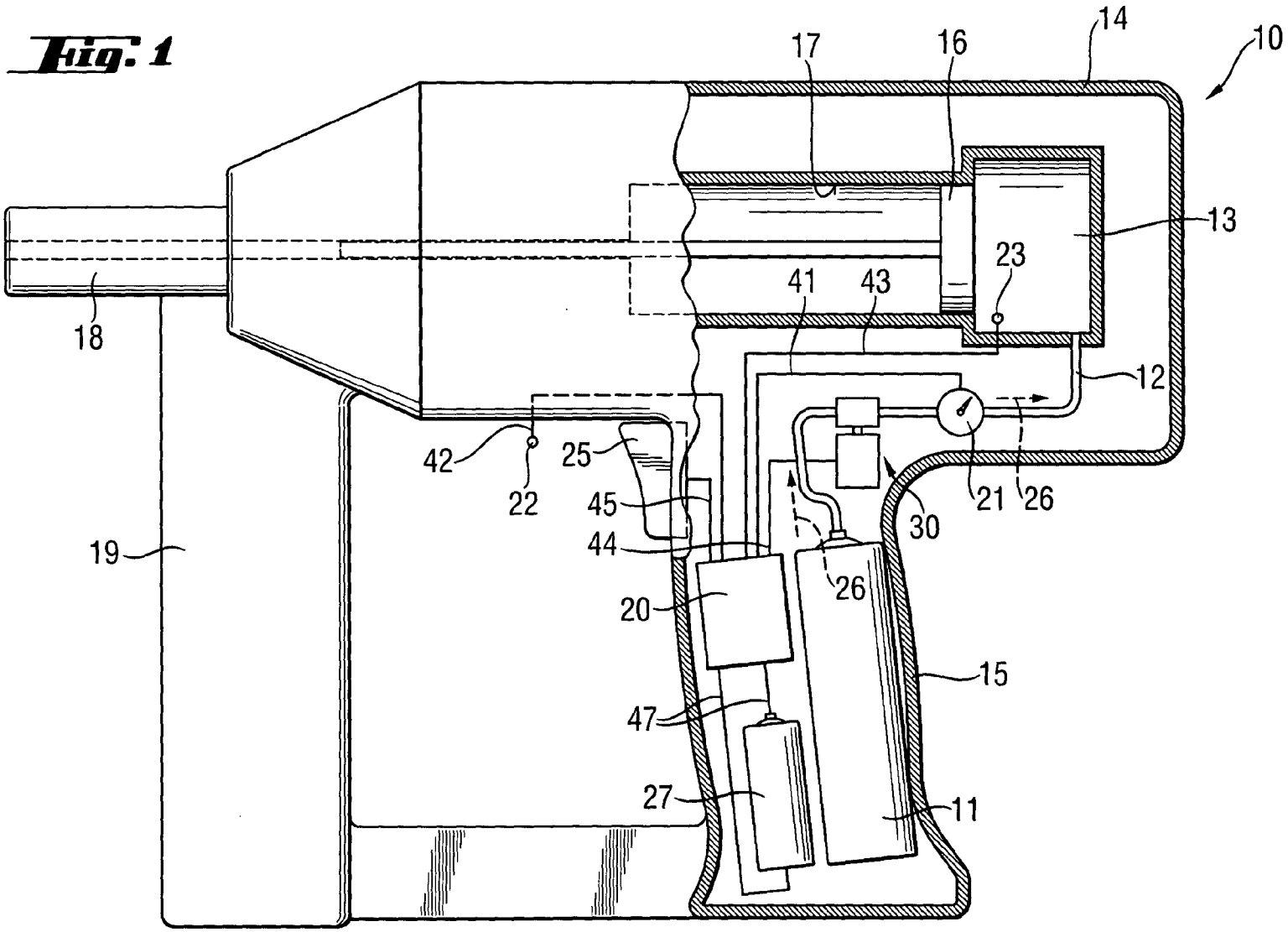
FIG. 1 a side, partially cross-sectional view of a setting tool according to the present invention.
Figure 3:
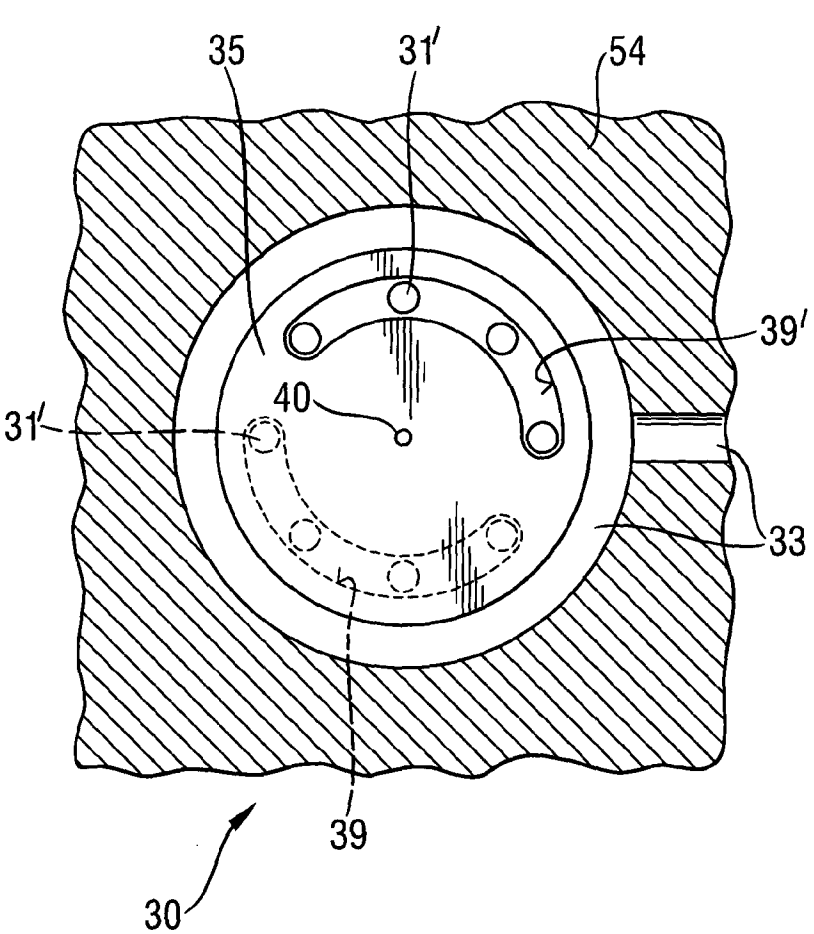
FIG. 3 a cross-sectional view along line II—II in FIG. 2.
Figure 2:
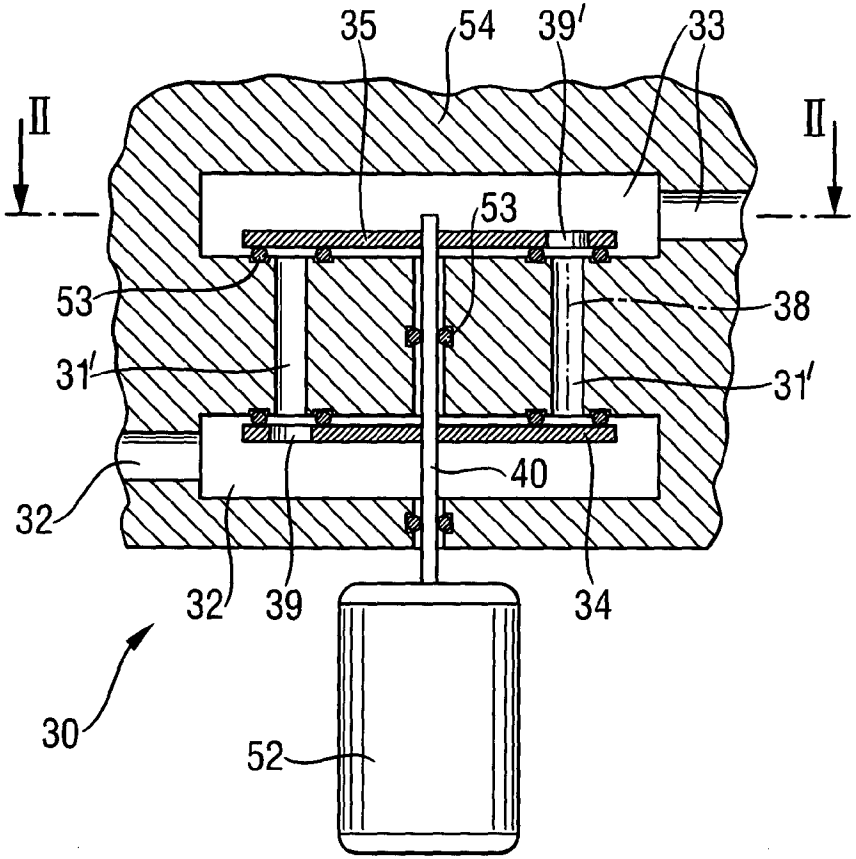
FIG. 2 a cross-sectional view of a metering device of the inventive setting tool according to a first embodiment.

A setting tool 20 according to the present invention, which is shown in FIGS. 1–3, is shown in its initial or idle position. The setting tool 10 operates on a fuel gas. The setting tool 10 has a housing 14 in which there is located a setting mechanism that drives a fastening element (not shown) in a constructional component (likewise not shown) when the setting tool 10 is pressed against the constructional component.

The setting mechanism includes, among others, a combustion space or combustion chamber 13, a piston guide 17, in which a drive piston 16 is displaceably supported, and a bolt guide 18 in which a fastening element can be located. The fastening element is displaceable and can be driven in a constructional component by a forward-moving, setting direction-end of the drive piston 16. The fastening elements can be stored in a magazine 19 attachable to the setting tool 10.

In the embodiment shown in FIGS. 1–3, an ignition unit, e.g., a spark plug 23 is located in the combustion chamber 13. The spark plug 23 serves for ignition of a fuel gas-air mixture which is brought into the combustion chamber 13 for effecting a setting process. The fuel gas is fed into the combustion chamber 13 from a fuel reservoir or fuel source 11 through a fuel conduit 12. The flow of the fuel gas from the fuel source 11 into the combustion chamber 13 shown with arrow 26 in FIG. 1.

In the fuel conduit 12, there are located an electronically controlled metering device 30 and a counter 21 located downstream of the metering device 30 in the flow direction of the fuel gas. The metering device 30 and the counter 21, e.g., a integrated flow meter, are arranged in a row one after another.

The inventive setting tool 10 further includes an electronic control device 20 which is connected by an electrical conductor 47 with a power source 27, e.g., a battery or an accumulator.

The control device 20 can be provided, e.g., with a microprocessor in which a control program for one or several functions of the setting tool 10 can run. The control device 20 can control metering of the fuel by controlling the electronic metering device 30. The fuel will be fed into the combustion chamber 13 from the metering device 30 in form of n-number of separate fuel portions.

The control device 20 is connected with the metering device 30 by an electrical conductor 44 and is connected with the flow meter 21, which located downstream of the metering device 30, by an electrical conductor 41. An electrical conductor 43 connects the control device 20 with the spark plug 23. An electronically operated switch means or a trigger switch 25 is arranged on a handle 15 of the setting tool 10 and is connected with the control device 20 by an electrical conductor 45. The control device 20 can also process measuring data and parameters of different sensors such as, e.g., a sensor 22 for sensing air pressure and air humidity. The sensor 22 is connected with the control device 20 by an electrical conductor 42. It should be noted that the electrical conductors 41, 42, 43, 44, 45, 47 can serve for both supplying the electrical energy and data transmission. Other sensors, besides the sensor 22, can transmit data to the control device 20. The other sensors can sense other parameters of the setting tool such as, e.g., temperature, position of the piston, etc . . .

FIGS. 2–3 show the structure of a first embodiment of the metering device 30. The metering device 30 has a housing 54 and at least one metering chamber 31'. In the embodiment shown in FIGS. 2–3, eight metering chambers 31' are provided in the housing 54. The metering chamber 31' has a shape of a cylinder that extends along an axis 38 and is open at both ends opening, respectively, into an inlet 32 and an outlet 33. The inlet 32 is connected with a portion of the fuel conduit 12 leading from the fuel reservoir 11 (not shown in FIGS. 2–3, whereas the outlet 33 is connected with a portion of the fuel conduit 12 leading into the combustion chamber 13 (likewise not shown in FIGS. 2–3). In front of the ends of the metering chambers 31', there are arranged, respectively, disc-shaped closing means 34 and 35 which are fixedly secured on an axle 40 for joint rotation therewith. The disc-shaped closing means 34, 35 have, respectively, passages 39, 39' movable in front of the metering chambers 31', opening the same into the inlet 32 and the outlet 33, respectively. The disc-shaped closing means 34, 35 are so arranged relative to each other that the passages 39, 39' are located diagonally with respect to each other. This, the oppositely located chambers 31' can be opened and closed, respectively, in opposite directions (inlet direction and outlet direction). E.i., when one of two oppositely located chambers 31' is open into the inlet 32, the other of the two oppositely located chambers 31' is open in the outlet 33 with the one and the other chambers 31' being closed with respect the outlet 33 and the inlet 32, respectively.

The axle 40 is driven by a motor 52, in particular, stepping motor, which is connected by an electrical conductor 44 with the control device 20 that controls the motor 52 and supplies it with energy. The motor 52 and the axle 40 provide for angular displacement of the disc-shaped closing means 34 and 35 relative to the stationary metering chambers 31'. Upon a single revolution of the closing means 34 and 35, each of the chambers 31' once opens into the inlet 32 and once opens into the outlet 33 by respective passages 39, 39' in the closing means 34, 35. In this way, upon a complete revolution of the closing means 34, 35, a volume of the metering chambers 31' is metered exactly eight times and is displaced from the inlet 32 to the outlet 33. If all of the eight metering chambers 31' are considered to constitute a single volume, then upon each revolution, a separate portion of the fuel is displaced from the inlet 32 to the outlet 33 of the metering device 30 and is metered out. The n-number in this case is one. The control device 20 can control the motor 52 of the metering device 30 dependent on the reading by one or more sensors 22 of the air pressure, air humidity, tool temperature, etc . . . , and provide for another value of n. In this way, the number of separate portions of fuel metered into the combustion chamber 13 can be so calculated that the number of separate portions optimally adapted to the amount of oxygen entering the combustion chamber 13 (from the surrounding air or from a source of concentric oxygen).

The flow meter 21 monitors if the calculated amount of fuel flow through the fuel conduit 12 into the combustion chamber 13. The data generated by the flow meter 21 are transmitted via the conductor 41 to the control device 20 which upon deviation from a set value, can correct the amount of fuel by changing the parameter n by controlling the operation of the metering device 30 with a corresponding signal that is communicated to the motor 52 via the conductor 44. By a pulsed delivery of fuel in form of separate portions n into the combustion chamber 13, a complete evaporation of the fuel is achieved as, e.g., with a time-controlled delivery when the fuel is fed into a combustion chamber with one surge.

The movable parts of the metering device 30 are sealed against each other by seals 53. Thereby, an uncontrolled overflow of fuel from the inlet 32 to the outlet 33 is prevented.

Figure 4B:
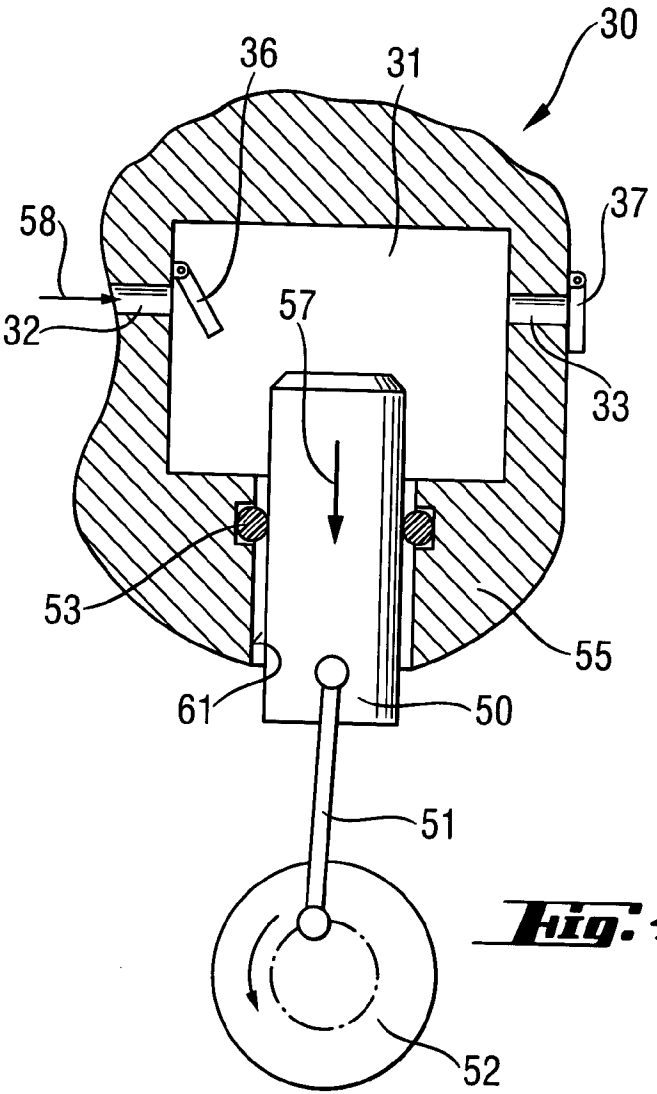
FIG. 4*b* a view identical to that of FIG. 4*a* but with displaceable body movable in a second direction.
Figure 4A:
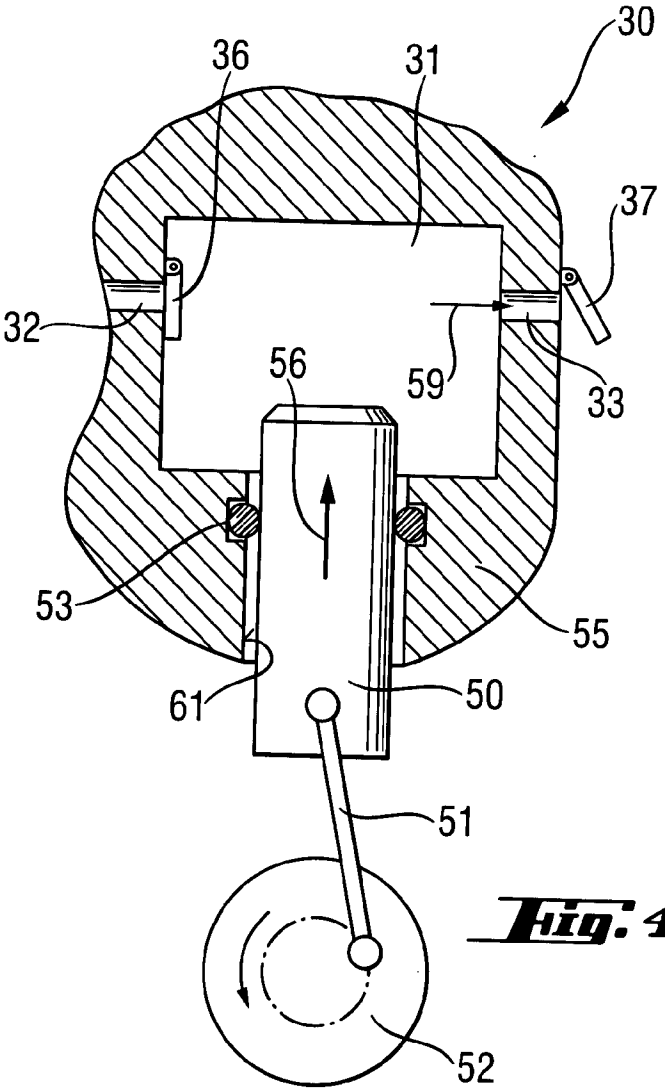
FIG. 4*a* a cross-sectional view corresponding to that of FIG. 2 of a second embodiment of a metering device of the inventive setting tool according to the present invention, with the displaceable body movable in a first direction.

FIGS. 4*a* and 4*b* show a second embodiment of the metering device 30 according to the present invention for a pulsed delivery of fuel from the fuel reservoir 11. The metering device 30, which is shown in FIGS. 4*a*–4*b*, has a housing 55 with a single metering chamber 31. The housing 55 further includes and inlet 32 which communicates with the fuel reservoir 11 via a section of the fuel conduit 12 leading from the fuel reservoir (both not shown in FIGS. 4*a*–4*b*). The housing 55 also includes an outlet 33 that communicates with a section of the fuel conduit 12 leading to the combustion chamber 13 (likewise not shown in FIGS. 4*a*–4*b*). The inlet 32 can be closed by closing means 36, e.g., a flap valve located in the metering chamber 31, when a pressure built-up takes place in the metering chamber 31. However, the closing means 36 opens the inlet 32 when the pressure in the metering chamber 31 falls below the admission pressure (whereby the pressure, in case of metering of a liquid fuel, always remains above the vaporization pressure so that the fuel is always in a liquid phase), and fuel can flow in the direction 58 into the metering chamber 31. The outlet 33 is closed from outside by appropriate closing means 37 which likewise can be formed as a flap valve. The closing means 37 opens the outlet 33 upon the built-up of pressure in the metering chamber 31, whereby the medium (fuel) flows from the metering chamber 31 through the outlet 33 in the direction 59 to the combustion chamber. At the same time, the closing means 37 prevents medium from flow in the opposite direction. A cylindrical space 61 is also formed in the wall of the housing 55. The cylindrical space 61 communicates with the metering chamber 31. A displaceable body 50 is located in the cylindrical space 61 and is sealed against the side wall of the cylindrical space 61 with at least one sealing member 53. The displaceable body 50, which can be formed, e.g., as a piston, is pivotally connected at its end remote from the metering chamber 31 with a driving rod, e.g., an actuation member 51 connected with a drive motor 52 formed, e.g., as a stepped motor.

When the control device 20 (please see FIG. 1) communicates an actuation signal to the motor 52 via the conductor 44 to cause delivery of n separate portions of fuel from the metering device 30, the motor 52 would perform n revolutions, whereby the displaceable body 50 would be alternatively displaced n times in the direction 56 and n times in the direction 57. Thereby a predetermined fuel volume would be aspirated n times through the inlet 32, upon respective opening of the flap valve 36, into the metering chamber 31 upon movement of the displaceable body 50 in the direction 57, and would be expelled n times through the outlet 33 upon opening of the flap valve 37 when the displaceable body 50 is displaced in the direction 36.

The metering device 30, which is shown in FIGS. 4*a*–4*b*, is likewise used in the setting tool 10 shown in FIG. 1.

Figure 5B:
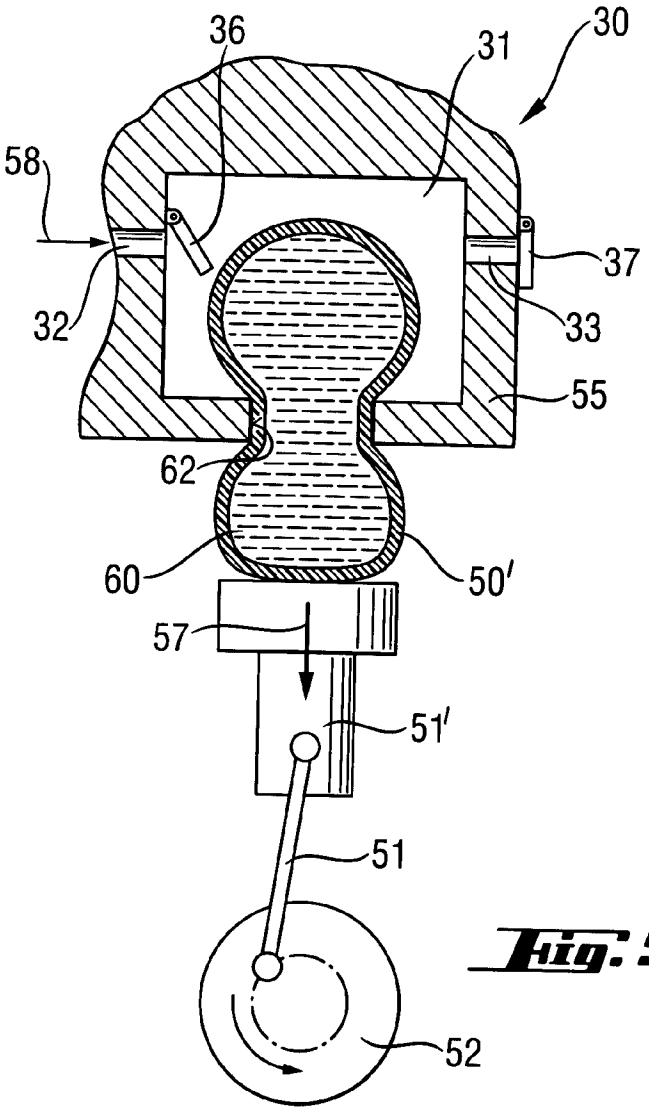
FIG. 5*b* a view identical to that of FIG. 5*a* but with the displaceable body movable in a second direction.
Figure 5A:
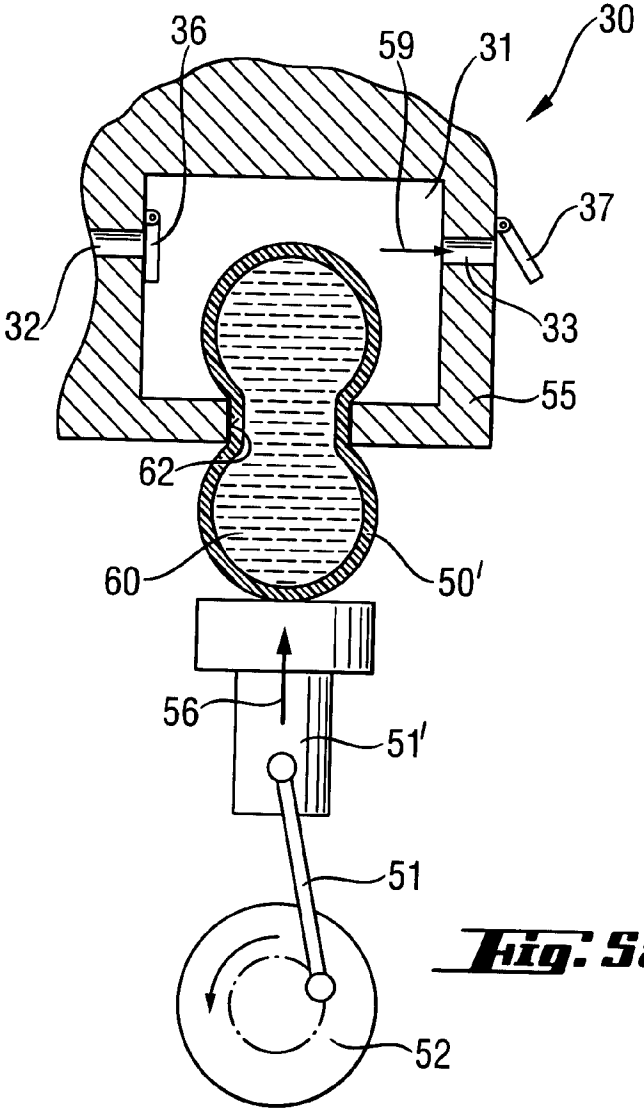
FIG. 5*a* a cross-sectional view corresponding to that of FIG. 2 of a third embodiment of a metering device of the inventive setting tool according to the present invention with the displaceable body movable in a first direction.

A further embodiment of the metering device 30 according to the present invention is shown in FIGS. 5*a* and 5*b*. The metering device 30, which is shown in FIGS. 5*a*–5*b*, likewise has a housing 55 with a metering chamber 31 having an inlet 32 and an outlet 33 which are closable, respectively, by closing means 36 and closing means 37. The closing means 36 and the closing means 37 function in the same manner as the corresponding means 36 and 37 of the metering device 30 shown in FIGS. 4*a*–4*b*.

The housing 55 has a through-opening 62 through which a displaceable body 50' extends. The displaceable body 50' is formed as an elastic member, e.g., as dumbbell-shaped body with a rubber-elastic outer sheath. The displaceable body 50' is filled with an incompressible medium 60, e.g., a hydraulic oil or any other appropriate fluid. The displaceable body 50' is retained in the through-opening 62 with a press fit a portion of the displaceable body 50' is located in the metering chamber 31, with the other portion being located outside of the housing 55. The portion of the displaceable body 50', which is located outside of the housing 55 seats on an operational member 51', e.g., a piston mechanically connected with a drive motor 52, e.g., a stepped motor, by a driving rod 51. The drive motor 52 causes reciprocating movement of the operational member 51' as a result of which the displaceable body 50' is subject to periodical impacts. With each displacement of the displaceable member 51' in the direction 56, the displaceable body 50', which is filled with incompressible medium 60 is pressed into the metering chamber 31, which causes flow of fuel in the direction 59 through the outlet 33 and into the feeding conduit 12 to the combustion chamber 13. With each displacement of the displaceable member 51' in the direction 57, the displaceable body 50' returns to its initial condition. This leads to opening of the flap valve 36 and flow of fuel in the direction 58 through the inlet 32 and into the metering chamber 31. With each revolution of the drive motor 52, the operational member 51' is displaced once in the direction 56 and once in the direction 57. Thus, with each stroke of the operational member 51', a single portion of fuel is fed into the metering chamber 31 and is expelled therefrom through the outlet 33.

The further explanation is based on the foregoing discussion.

Figure 6B:
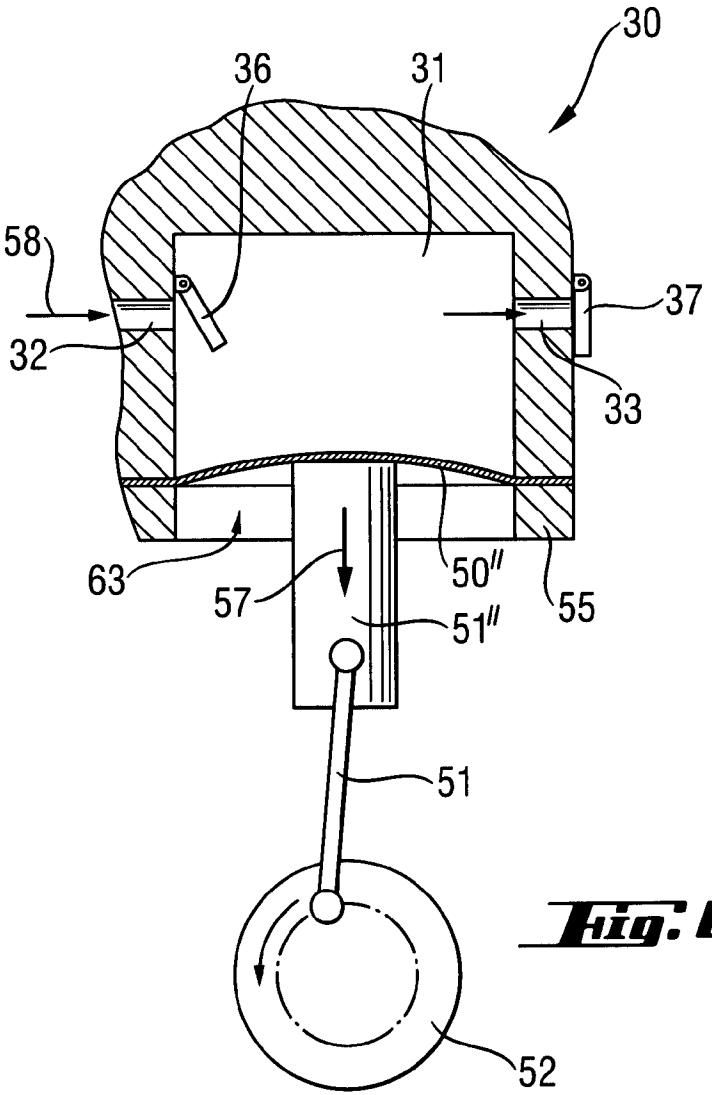
FIG. 6*b* a view identical to that of FIG. 6*a* but with the displaceable body movable in a second direction.
Figure 6A:
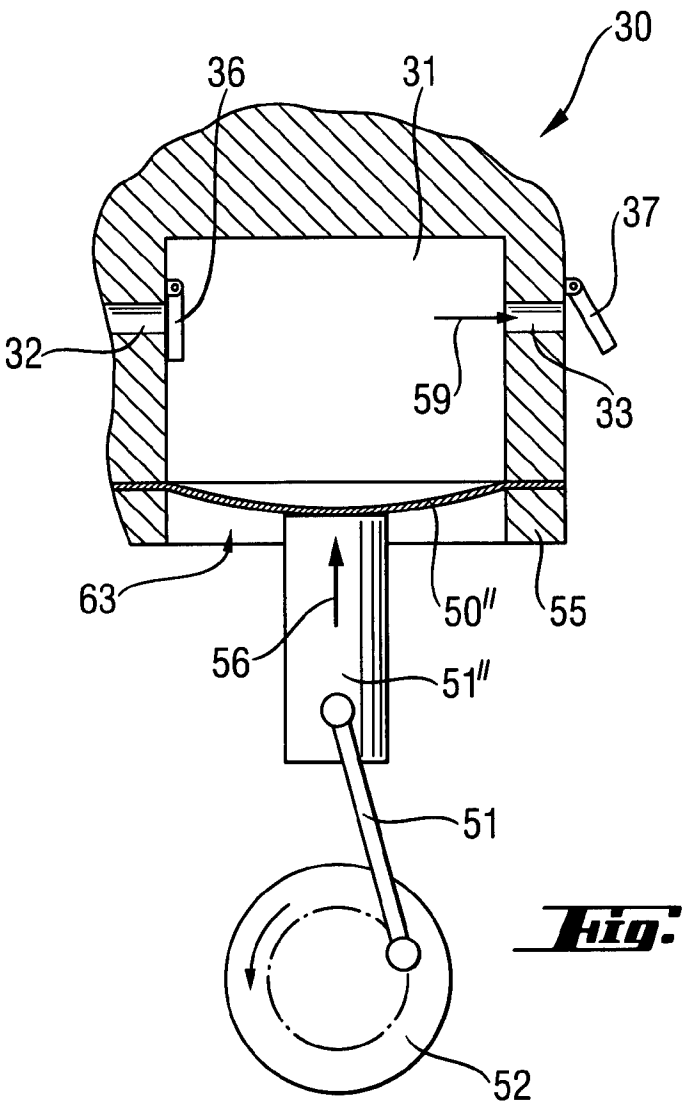
FIG. 6*a* a cross-sectional view corresponding to that of FIG. 2 of a fourth embodiment of a metering device of the inventive setting tool according the present invention with the displaceable body movable in a first direction.

A still further embodiment of the metering device 30 according to the present invention is shown in FIGS. 6*a*–6*b*. The metering device 30, which is shown in FIGS. 6*a*–6*b*, likewise has a housing 55 with a metering chamber 31 having an inlet 32 and an outlet 33 which are closed, respectively, in the inflow and outflow directions with respective closing means 36 and closing means 37. The housing 55 has an opening 63 which is completely closed by a displaceable body 50", which is formed as a diaphragm in the embodiment shown in FIGS. 6*a*–6*b*. The piston 51" is again displaced in opposite directions with a driving rod 51 connected mechanically with the drive motor 52 likewise formed as a stepped motor. A control device (not shown) communicates an actuation signal to the motor 52 for delivering separate portions of fuel to the metering device 30, which takes place upon displacement of the piston 51" in the direction 57 (FIG. 6*b*). The fuel flows in the direction 58 through the section of the feeding conduit 12 leading from the fuel reservoir 11 and through the inlet 32, with the closing means 36 being open by the pressure of the liquid fuel. Upon rotation of the drive motor 52 by half of a revolution, the piston 51" is displaced in the direction 56, with the displaceable body 50" being displaced in the same direction 56. Upon displacement of the displaceable body 50" in the direction 56, the closing means 36 closes the inlet 32, and the fuel flows in the direction 59 through the outlet 33, with the closing means 37 being opened by the pressure of the fuel in the metering chamber 31. From the metering device 30, the fuel flows through the respective section of the feeding conduit 12 toward the combustion chamber 13 (both not shown in FIGS. 6*a*–6*b*). By rotating the drive motor 52 with N revolution, the separate portions of fuel can be metered out and fed into the combustion chamber 13.

For a detailed explanation, please see the description above.

Thought the present invention was shown and described with references to the preferred embodiments, such are merely illustrative of the present invention and are not to be construed as a limitation thereof, and various modifications to the present invention will be apparent to those skilled in the art. It is, therefore, not intended that the present invention be limited to the disclosed embodiment or details thereof, and the present invention includes all of various and/or alternative embodiments within the spirit and scope of the present invention as defined by the appended claims.

What is claimed is:

1. A combustion-engined setting tool for driving fastening elements in a constructional component, comprising a combustion chamber (13); a fuel source (11); a fuel conduit (12) for connecting the fuel source (11) with the combustion chamber (13); at least one metering device (30) arranged in the fuel conduit (12) for metering out a predetermined amount of fuel in each operation cycle in form of an n-number of discrete equal volume, separate portions, wherein n>1, with a preset volume of the separate portions remaining constant; and a control device (20) for actuation of the metering device (30).

2. A setting tool according to claim 1, further comprising sensor means (22) for determining parameters of the setting tool and of the environment and for communicating acquired data to the control device (20), whereby the control device (20) determines, for each operation cycle, the n-number based on the determined parameters of the setting tool and the environment.

3. A setting tool according to claim 2, wherein the sensor means (22) comprises sensors for determining air pressure, temperature, and air humidity of surrounding the setting tool, air.

4. A setting tool according to claim 2, wherein the control device (20) is formed as a data processing unit for evaluating and processing the acquired parameters.

5. A setting tool according to claim 4, wherein the data processing unit is formed as a microprocessor.

6. A setting tool according to claim 1, further comprising a counter flow meter (21) associated with the metering device (30) for determining volumes of metered-out fuel and for transmitting acquired data to the metering device (2) for adjusting a set value of the n-number.

7. A setting tool according to claim 6, wherein the counter (21) is formed as an integrated flow meter.

8. A setting tool according to claim 6, wherein the counter (21) is formed as a step counter.

9. A combustion-engined setting tool for driving fastening elements in a constructional component, comprising a combustion chamber (13); a fuel source (11): a fuel conduit (12) for connecting the fuel source (11) with the combustion chamber (13); at least one metering device (30) arranged in the fuel conduit (12) for metering out a predetermined amount of fuel in form of a n-number of discrete separate portions. with a preset volume of each separate portion remaining constant; and a control device (20) for actuation of the metering device (30), wherein the metering device (30) comprises at least one metering chamber (31, 31') having inlet (32) and outlet (33), and closing means (34, 35, 36, 37) for reversibly closing the inlet (32) and the outlet (33), and wherein during one working cycle, the inlet (32) and the outlet (33) are alternatively and periodically opened and closed n-times.

10. A setting tool according to claim 9, wherein the metering device (30) has plurality of metering chamber (31') arranged annularly about a central axis (40) and having axes (38) thereof extending parallel to each other, wherein the metering chamber (31') are open at opposite ends thereof, and wherein the closing means (34, 35) comprises disc-shape plates having each a passage (39) and rotatable relative to the metering chambers (31'), whereby the opposite open ends of the metering chambers (31') are alternatingly and reversibly closed by respective disc-shaped plates.

11. A setting tool according to claim 10, further comprising a drive motor (52) for rotating the disc-shaped plates (34, 35).

12. A setting tool according to claim 9, wherein the at least one metering chamber (31) is associated with a displaceable body (50, 50', 50") which changes an inner volume of the at least one metering chamber (31).

13. A setting tool according to claim 12, wherein the metering device is actuated by a solenoid.

14. A setting tool according to claim 13, wherein the solenoid acts on the displaceable body.

15. A setting device according to claim 12, further comprising a drive motor (52) for actuating the metering device (30).

16. A setting device according to claim 15, wherein the drive motor (52) acts on the displaceable body (50, 50', 50").

* * * * *